United States Patent [19]

Shafto

[11] Patent Number: 4,768,658

[45] Date of Patent: Sep. 6, 1988

[54] RACK FOR WIRE HANGERS

[75] Inventor: Larry L. Shafto, Pittsburg, Calif.

[73] Assignee: Ambassador Sales Company, Los Angeles, Calif.

[21] Appl. No.: 123,702

[22] Filed: Nov. 23, 1987

[51] Int. Cl.[4] ..... A47F 5/01

[52] U.S. Cl. ..... 211/49.1; 211/59.1; 211/181

[58] Field of Search ..... 211/49.1, 59.1, 181

[56] References Cited

U.S. PATENT DOCUMENTS 2,530,609 11/1950 Friedman ..... 211/49.1
2,918,174 12/1959 Tabbi ..... 211/49.1
3,490,599 1/1970 Von Maur ..... 211/49.1
4,424,905 1/1984 Keen ..... 211/49.1

FOREIGN PATENT DOCUMENTS 719128 11/1954 United Kingdom ..... 211/49.1

*Primary Examiner*—Robert W. Gibson, Jr.
*Attorney, Agent, or Firm*—Keith D. Beecher

[57] ABSTRACT

A rack for wire hangers which enables the hangers to be stored after use with their hooks facing in one direction, so that they may conveniently be returned to a distribution center for re-use.

3 Claims, 1 Drawing Sheet

RACK FOR WIRE HANGERS

BACKGROUND OF THE INVENTION

It is usual for garments and other articles to be distributed from dry cleaning and other distribution centers to commercial, industrial and domestic customers on wire hangers. The wire hangers are often thrown out by the customers after use which is wasteful.

Attempts have been made in the past to supply the customers with appropriate racks on which the hangers may be stacked. The distributor then picks up the racks periodically and brings the hangers back to the distribution center for re-use.

However, a problem with the prior art racks is that the hangers may be stacked in them with their hooks facing in either direction. This requires manual labor at the distribution center, because after the hangers have been removed from the racks, they must be arranged so that all the hooks face in one direction before they can be hung on appropriate bars and re-used.

Accordingly, an object of the present invention is to provide a rack which is constructed so that the wire hangers can be stacked in the rack only with their hooks facing in one direction. This greatly facilitates the handling of the hangers after they have been returned to the distribution center, because they need only to be removed from the racks and hung on the bars, without any re-orientation of the hangers being required.

Another object of the invention is to provide such a rack which may conveniently be nested into other like racks to conserve space when the racks are transported from one location to another.

DETAILED DESCRIPTION OF THE ILLUSTRATED EMBODIMENT

Figure 1:
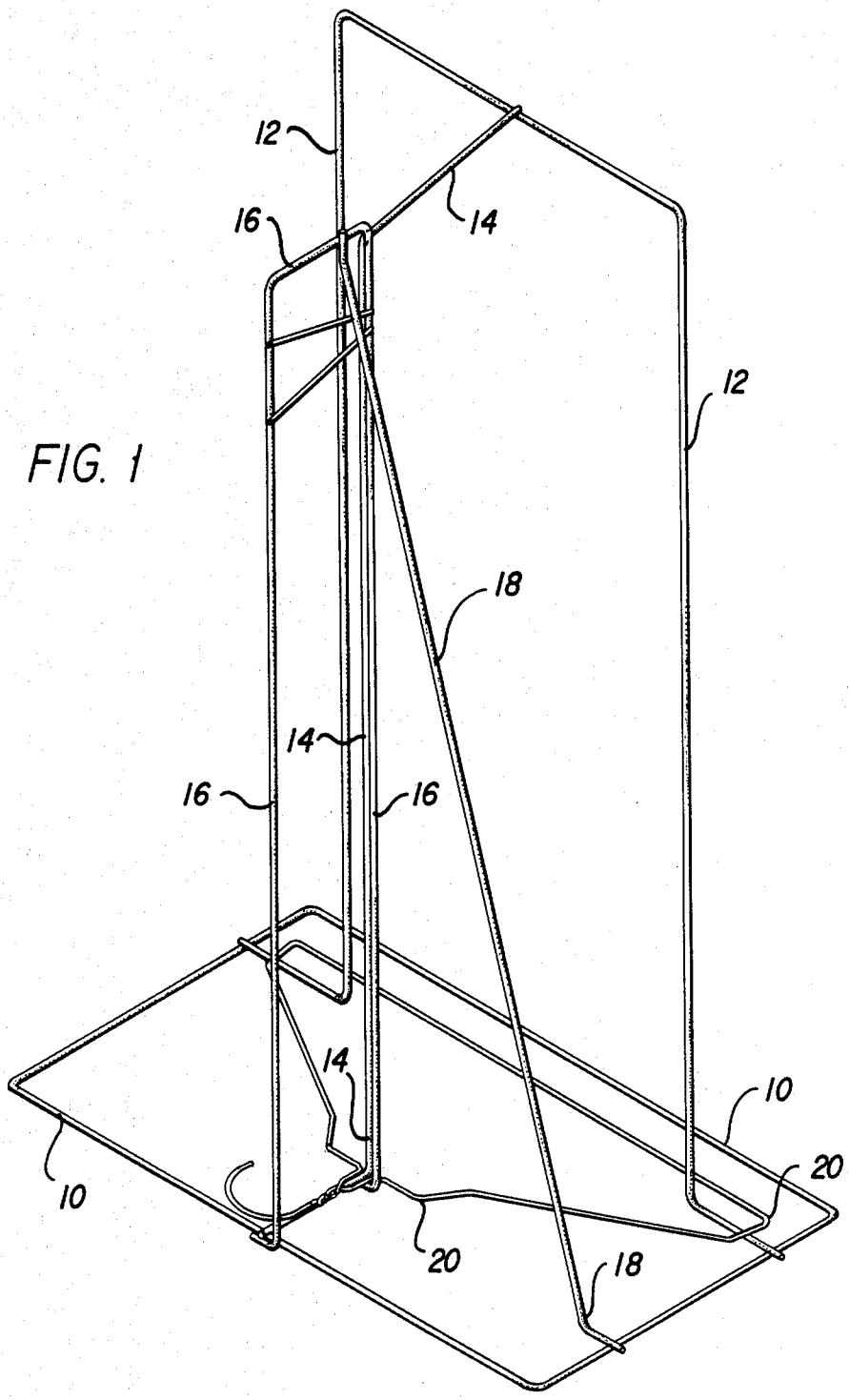
FIG. 1 is a perspective view of a wire-formed rack constituting one embodiment of the invention.

The wire-formed rack shown in FIG. 1 includes a base 10 formed of a bar bent into a rectangular configuration. An upright stand in the form of a U-shaped bar 12 is mounted on the base 10, and welded to the base. A Z-shaped bar 14 has one end welded to the base, and its other end welded to the top of U-shaped bar 12. The Z-shaped bar 14 and U-shaped bar 12 form a structure for receiving the wire hangers, such as the hanger 20.

A second U-shaped bar 16 is welded to the base 10, and it extends perpendicularly to the U-shaped bar 12. The U-shaped bar 16 is spaced from the Z-shaped bar 14 to define an upright slot between the two bars. A support bar 18 may also be provided, as shown, which is welded to the base 10, and to the top of bar 16.

The assembly is such that when hangers, such as the hanger 20 are dropped into the rack, the neck portion slides down the slot between the bar 16 and bar 12. However, only if the hangers are oriented so that their hooks face in the direction shown in FIG. 1, will the hangers be received in the rack. Otherwise, the hook of the hanger engages the top of the bar 16, and the hanger is prevented from falling down into the rack. In this way, the hangers are received in the rack only when the hooks are facing in one particular direction.

The invention provides, therefore, an improved rack, whereby a customer may store wire hangers, so that the rack may periodically be picked up by the distributor and the wire hangers returned to the distribution center.

As described, a feature of the rack of the invention is that the wire hangers may be stored in the rack only with their hooks facing in a particular direction.

Another feature of the rack shown in FIG. 1 is that it may conveniently be nested into other like racks to save space when the racks are transported empty from one location to another.

It will be appreciated that while a particular embodiment of the invention has been shown and described, modifications may be made. It is intended in the claims to cover all modifications which come within the true spirit and scope of the invention.

I claim:

1. A wire-formed rack for hook-type wire hangers comprising: a base; an upright stand for storing the wire hangers in a stacked formation with the hangers surrounding the stand, after the hangers have been successively dropped into the rack; said stand including a U-shaped bar attached to said base, and a Z-shaped bar attached at one end to said base and at the other end to the top of said U-shaped bar, with the Z-shaped bar being displaced from the plane defined by said U-shaped bar; and a stop member mounted adjacent to the top of said stand for preventing the hangers from dropping into the rack unless the hooks thereof have a particular orientation.

2. The rack defined in claim 1, and which includes a second U-shaped bar attached to said base at right-angles to said first-named U-shaped bar and spaced therefrom with the top of said second U-shaped bar forming said stop member.

3. The rack defined in claim 2, in which the bars forming said rack are positioned to permit the rack to be nested into other like racks.

* * * * *